United States Patent [19]

Killa

[11] Patent Number: 4,846,989

[45] Date of Patent: Jul. 11, 1989

[54] SOLID CAST WAREWASHING COMPOSITION AND PROCESS FOR PREPARING THE SAME

[75] Inventor: Marlene C. Killa, St. Paul, Minn.

[73] Assignee: Ecolab Inc., St. Paul, Minn.

[21] Appl. No.: 230,709

[22] Filed: Aug. 5, 1988

Related U.S. Application Data

[63] Continuation of Ser. No. 156,302, Feb. 12, 1988, abandoned, which is a continuation of Ser. No. 71,092, Jul. 8, 1987, abandoned, which is a continuation of Ser. No. 798,733, Nov. 15, 1985, abandoned.

[51] Int. Cl.[4] ..... C11D 7/16; C11D 7/56

[52] U.S. Cl. ..... 252/99; 252/90; 252/92; 252/174; 252/174.13; 252/187.24; 252/187.25; 252/187.26

[58] Field of Search ..... 252/90, 92, 99, 174, 252/187.24, 187.25, 187.26, 174.13

[56] References Cited

U.S. PATENT DOCUMENTS

| | | | |
|---|---|---|---|
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 2,412,819 | 12/1946 | MacMahon | 252/138 |
| 2,920,417 | 1/1960 | Wertheimer | 45/28 |
| 3,058,917 | 10/1962 | Lintner | 252/99 |
| 3,248,330 | 4/1966 | Feierstein et al. | 252/99 |
| 3,314,891 | 4/1967 | Schmolka et al. | 252/89 |
| 3,368,978 | 2/1968 | Irani | 252/137 |
| 3,656,890 | 4/1972 | Toy et al. | 23/50 |
| 3,933,670 | 1/1976 | Brill et al. | 252/99 |
| 4,228,025 | 10/1980 | Jacobsen | 252/99 |
| 4,569,780 | 2/1986 | Fernholz et al. | 252/90 |
| 2,9987,483 | 6/1961 | Brooker | 252/138 |

FOREIGN PATENT DOCUMENTS 687075 2/1953 United Kingdom .

OTHER PUBLICATIONS

Vol. 3 of the *Kirk-Othmer Encyclopedia of Chemical Technology,* second edition (1964), pp. 550–566, "Bleaching Agents".

Vol. 8 of the *Kirk-Othmer Encyclopedia of Chemical Technology,* second edition (1965), pp. 102–116.

*Primary Examiner*—Prince E. Willis

*Attorney, Agent, or Firm*—Merchant, Gould, Smith, Edell, Welter&Schmidt

[57] ABSTRACT

A solid cast warewashing detergent composition that can be formed, cast and distributed within a container or capsule. The cast composition which has improved cleaning, bleaching and dissolution properties, can be made by forming a hydration mass of an alkali metal metasilicate, an alkali metal phosphate, an alkali metal hypochlorite, chlorinated alkali metal phosphate, and sufficient water of hydration to harden the mass. Such cast detergent compositions can be attached to dispensing mechanisms in warewashing machines and can generate, as a result of the action of a stream of water on the cast material, a high performance warewashing solution.

28 Claims, No Drawings

SOLID CAST WAREWASHING COMPOSITION AND PROCESS FOR PREPARING THE SAME

This is a continuation of application Ser. No. 07/156,302, filed Feb. 12, 1988, which is a continuation of application Ser. No. 07/071,092, filed July 8, 1987, which is a continuation of appliation Ser. No. 06/798,733 filed Nov. 15, 1985 all abandoned.

FIELD OF THE INVENTION

The invention relates to solid-cast, high performance, mildly alkaline, alkali metal silicate containing compositions useful in cleaning dishware, flatware, glassware, and other ware in a household, institutional, or industrial warewashing machines. More particularly, the invention relates to a silicate containing cleaning composition having a source of chlorine and hardness sequestering agent that are cast in solid form and held within containers that can be installed in dispensing equipment in warewashing machines.

BACKGROUND OF THE INVENTION

Both highly alkaline, based on the alkali metal hydroxides, and mildly alkaline, based on an alkali metal silicate, cast detergent compositions are known. A great deal of attention has focused on formation of solid cast alkaline cleaning compositions in view of the inherent safety, high performance, convenience, and ease of use of the cast materials. Broadly I have found that the high performance alkaline cleaners can be made by blending alkail metal hydroxides, hardness sequestering agents and other optional compositions with water of hydration at elevated temperatures, casting the compositions and permitting the compositions to cool and solidify. I have also found that mildly alkaline compositions can also be cast by combining alkali metal silicates, hardness sequestering agents, and an inorganic composition that can act as hydrating-solidifying agents at low temperatures in the presence of hydrating amounts of water.

Both highly alkaline and mildly alkaline cast detergent compositions can provide excellent cleaning properties. The highly alkaline cleaning compositions as a result of the use of sodium hydroxide and hardness sequestering agents are highly effective in removing even the most stubborn soils from institutional and industrial ware. Mildly alkaline compositions have also been successfully used in high volume institutional cleaning systems, and have the added benefit that the silicates protect metal and glass surfaces from corrosion caused by the alkaline pH of the cleaner.

However, in a continual effort to provide cast materials having a variety of useful properties and improved cleaning efficiency, I have sought to increase the level of available chlorine and to increase the cleaning capacity of the mildly alkaline compositions by establishing the optimum levels of active components which provide the highest cleaning activity.

BRIEF DISCUSSION OF THE INVENTION

I have discovered that the warewashing detergent composition disclosed herein, having cleaning and bleaching properties and the ability to readily dissolve as a result of the action of a water spray, can be cast by forming a hydratable mass, in a mold consisting essentially of an effective cleaning metal and glass protecting amount of an alkali metal metasilicate, an effective hardness sequestering amount of an alkali metal condensed phosphate, an effective cleaning, bleaching and sanitizing concentration of both an alkali metal hypochlorite and a chlorinated alkali metal phosphate, and sufficient water to hydrate the mass. We have found, suprisingly, that the methods used to form the solid cast detergent composition of this invention are substantially different than the hardening agents and hardening methods used in the past such as in McMahon, U.S. Pat. Nos. 2,382,163, 2,382,164, 2,419,819, and in Applicant's copending application U.S. Ser. No. 509,916 now U.S. Pat. No. 4,569,780 when casting the caustic free alkali metal silicate cast cleaners disclosed herein. Further, we have found, surprisingly, that the combination of an alkali metal hypochlorite chlorine source with the chlorinated alkali metal phosphate chlorine source results in a substantial concentration of available chlorine that has enabled the attainment of substantial effective bleaching activities.

While we do not wish to be held to a theory of action of the invention, we have found that in the mildly alkaline compositions disclosed herein an auxiliary inorganic hydrating composition is unnecessary. The disclosed composition as defined by the invention, when combined, surprisingly hardens into a uniform cast material that has substantial mechanical integrity and readily dissolves in dispensing equipment. Effective cleaning solutions can be made by directing a sufficient, solubilizing amount of water to the cast composition forming a uniform, highly active cleaning solution.

DETAILED DISCUSSION OF THE INVENTION

Briefly, the solid cast warewashing composition of this invention comprises a solid, consisting essentially of an alkali metal silicate, an alkali metal condensed phosphate, an alkali metal hypochlorite, and a chlorinated alkali metal phosphate composition, which also includes an effective amount of water of hydration.

ALKALI METAL METASILICATE

The solid cast compositions of this invention contain an alkali metal metasilicate generally at a level of from about 20 to 30 wt-% on an anhydrous weight basis. Alkali metal metasilicate is generally expressed using the formula:

$$M_2O:SiO_2$$

indicating that alkali metal metasilicate is the reaction product of an alkali metal oxide ($M_2O$) and silicone dioxide ($SiO_2$). Typically alkali metal metasilicate is formed by reacting essentially equimolar amounts of the alkali metal oxide with the silicone dioxide. The properties and benefits of using alkali metal silicate can be obtained using an alkali metal silicate having an $M_2O$:-$SiO_2$ ratio of about 0.75–1.25:1, however the preferred metasilicate has a mole ratio close to unity (1:1). Alkali metal metasilicates have sufficient alkaline character to provide good cleaning performance but the pressure of substantial quantities of silicone dioxide within the ratios above can protect materials such as aluminum, china, glassware, crystalware, etc. from the etchant effect of the basic components of the cleaning system.

The preferred alkali metal silicate comprises sodium metasilicate having an $Na_2O:SiO_2$ ratio of about 1:1. Sodium metasilicate is preferred for reasons of high cleaning performance, delicate ware protection and low cost.

The alkali metal metasilicate can be used in the form of anhydrous sodium metasilicate, potassium metasilicate hydrate, or the form of the reaction product of a slurry of silicone dioxide and an alkali metal hydroxide which can be formed in situ during the formation of the cast material.

ALKALI METAL CONDENSED PHOSPHATE

The solid cast warewashing compositions of this invention can contain an alkali metal condensed phosphate which typically provides both builder properties and hardness sequestering properties to the cleaning solutions which are produced in the machine warewashing unit by directing a water stream onto the cast material. The condensed phosphate compositions useful in the practice of this invention are the water soluble alkali metal salts of pyrophosphoric acid ($H_4P_2O_7$), tripolypohsphoric acid ($H_5P_3O_{10}$), and similar condensed phosphoric acids having the generic formula $(HPO_3)_n$, wherein the value of n is generally between 3 and 20. The cast cleaning compositions of this invention typically contain about 20 to 25 wt-% of the alkali metal condensed phosphate compositions in order to attain both elevated cleaning activity and in order to successfully form a cast material.

Preferred condensed phosphate compositions for this invention comprise commercial sodium tripolyphosphate. Broadly, both granular sodium tripolyphosphate and powdered sodium tripolyphosphate can be used in combination with the alkali metal silicate in the castable compositions of the invention. However, depending on humidity, operating conditions, or both the casting operation and the end use machine warewashing equipment, high levels of powdered materials can tend to reduce efficiency of production and use of the cast materials of the invention. Powdered material can tend to cake and can result in inefficient mixing and dispensing of the sequestrant. Mixtures of granular and powdered condensed phosphate materials can be used, however preferably granular sodium tripolyphosphate is used.

SOURCE OF ACTIVE CHLORINE

The solid cast warewashing composition of this invention contains a source of active chlorine which provides both cleaning and sanitizing properties. Often food soils are complex organic compounds that derive color from the chemical structure of the constituent biochemical substances. These substances are typically made up of unsaturated, cyclic and heterocyclic compositions. Sources of active chlorine can chemically attack such structures and can alter the chemical nature of the compounds rendering them colorless. Further, the active chlorine can act as a sanitizing agent since the released chlorine can attack microorganisms, virus, fungi, molds, and other potentially harmful organisms which may exist on the ware. Applicant has found that to obtain the surprising and unusual levels of cleaning performance, a combination of both an alkali metal hypochlorite and a chlorinated alkali metal phosphate compound is necessary.

Typically alkali metal hypohalite compositions are formed in aqueous solutions of active alkali metal hypohalite typically made by passing chlorine gas through aqueous solutions of the alkali metal hydroxide. Solutions of the alkali metal hypohalite are made which contain from about 8 to 10.5 wt-% active alkali metal hypohalite. Preferred alkali metal hypohalite contains about 10% of sodium hypochlorite in an aqueous solution.

The term "chlorinated trialkali phosphate compounds" generally refers to the addition compound product of the reaction between an alkali metal hypochloride and an alkali metal phosphate. Such materials are effective alkaline components in cleaning compositions. The preferred chlorinated alkali metal phosphate comprises a compound of the formula: $_4(Na_3PO_4 \cdot X\text{-}H_2O \cdot HaOCl)$, wherein X comprises about 5 to 15.

In somewhat greater detail, the solid cast detergent composition of this invention can be manufactured by combining the components in a suitable mixer having sufficient resistance to chemical attack from the ingredients and sufficient mixing capacity. While the ingredients can be mixed generally in any order without substantially reduced properties, the preferred mode of preparing the composition is first charging to a large industrial scale mixer the water component of the cast solid and the alkali metal hypochlorite. After mixing the water and alkali metal hypochlorite commonly result in a clear, stable solution of sodium hypochlorite in water. Into the aqueous solution in the industrial mixer can then be placed the balance of the components which tend to be particulate or granular compositions which are only partially soluble at most in the aqueous medium. The alkali metal metasilicate, the sodium alkali metal tripolyphosphate and the chlorinated alkali metal phosphate can be added together or in any sequence. The industrial mixer is operated at a sufficient speed and horsepower to insure adequate mixing of the components. Once the components are fully mixed and uniform, the composition is drawn off into molds or capsules for solidification.

During processing the components can be mixed and drawn off into the capsule or mold while maintaining the temperature of the composition at less than 120°–130° F. Such temperature control enables the composition to retain a substantial proportion of the active chlorine concentration of the mixture of alkali metal hypochlorite and chlorinated alkali metal phosphate. Further, the ability to blend and cast the material at low temperature reduces consumption of energy and danger to operating personnel.

The capsule or mold into which the composition is placed for solidification has sufficient volume to permit introduction of about 1 to 10 pounds of material, preferably 8.0 to 9.5 pounds of material, and most preferably for reasons of convenience and expense, 8.85 to 9.15 pounds of material. The material can be introduced into molds, solidified and removed from the mold and placed into containers for shipment, however in a preferred mode the composition is introduced into a capsule which is the container in which it will be used in the warewashing machine. Typically the capsules comprise an unbreakable material which can be closed with a lid or cover to protect the material from the environment. The capsule can be made of metal, fiberglass or other composites, plastics, nylon or other suitable material. In a preferred mode the capsule can be manufactured so that it has an integral attachment means by which it can be attached to the warewashing machine in order to promote the production of the cleaning solution from the cast material through the action of a water spray. In one embodiment of this arrangement the capsule can have a screw thread collar means onto which a screw cap can be placed after solidification of the material. The material can be stored, shipped and delivered to the point of use. At the point of use the lid can be removed and the threaded collar can be used to attach the capsule and its contents onto a threaded ring in the dispensing portion of the ware-washing machine. The threaded collar can be threaded into the threaded ring of the machine in order to secure the capsule in the dispensing apparatus. The mating of the capsule with the machine can insure that the water spray contacts the cast solid material and that the cleaning solution produced by the water spray remains in the dispensing apparatus for delivery to the cleaning zone.

The following Examples provide further information with respect to understanding the invention described above and contain a best mode.

EXAMPLE I

Into a 500 gallon industrial mixing tank equipped with an electric stirring mechanism and steam heating jacket was placed 34.6 gallons (288 lbs) of soft water and 450 lbs. of a 9.47 wt-% active solution of sodium hypochlorite in water. The mixing apparatus was operated at 80 r.p.m. until the contents became uniform after a short period. Into the uniform solution was placed 450 lbs. of solid sodium metasilicate (Diamond Shamrock Corporation), the mixing equipment was operated at 80 r.p.m. and during addition and agitation the temperature of the suspension rose from 70° to 125° F. and slowly cooled to 111° F. Into the agitated suspension of sodium metasilicate was slowly added 396 lbs. of sodium tripolyphosphate (low density sodium tripolyphosphate made by Olin Chemical Corporation). The temperature of the suspension during addition of sodium tripolyphosphate rose from 111° F. to 118° F. During the addition of sodium tripolyphosphate the agitator was operated at 110 r.p.m. At the completion of the addition of the sodium tripolyphosphate, the mixture was heated with one minute of steam to reduce viscosity and into the suspension of sodium tripolyphosphate and sodium metasilicate was placed 216 lbs. of chlorinated trisodium phosphate. During the addition the agitator was operated at 120 r.p.m. The uniform composition was metered into plastic capsules having a capacity of about 8 lbs. of material. After two hours of cooling the composition hardened into a solid cast form.

EXAMPLE II

Example I was repeated except that 18.78 oparts of soft water, 29.22 parts of sodium hypochlorite, 29.33 parts of sodium metasilicate and 22.67 parts of sodium tripolyphosphate were substituted for the amounts in Example I.

EXAMPLE III

Example I was repeated except that 18.78 parts of soft water, 28.56 parts of sodium hypochlorite, 30.0 parts of sodium metasilicate, and a mixture of 11.33 parts of low density sodium tripolyphosphate and 11.33 parts of regular density sodium tripolyphosphate were substituted for the amount in Example I.

EXAMPLE IV

Into a 1,000 gallon stainless steel batch mixer equipped with an electric stirrer and steam heating jacket was added 1920 lbs. soft water and 3000 lbs. of sodium hypochlorite. The mixture was agitated until uniform and into the stirred aqueous solution was added 3000 lbs. of sodium metasilicate (Stauffer Chemical Company). The material was added slowly at 69 r.p.m. of the agitator, and the temperature increased during the addition from 68° F. to 127° F. at which time the composition was fully uniform. The mixture was cooled to a temperature of 96° F. and to the sodium metasilicate suspension was added 2640 lbs. of sodium tripolyphosphate (low density—Stauffer Chemical Company) slowly over a 30-minute period. The mixture was agitated at 85 r.p.m. and the temperature increased from 96° F. to 102° F. at the completion of the addition. After completion of the addition of the sodium tripolyphosphate 1440 lbs. of chlorinated trisodium phosphate (Stauffer Chemical Company—white) was added to the suspension over a period of about 1 hour. The temperature reached 107° F and the agitator was operated at 85 r.p.m. The material within the mixer had an available chlorine concentration of 2.721% and a viscosity at 50 r.p.m. at 106° F. of 1960 cps. Analysis of the product cast in capsules indicated that the available chlorine of the batch ranged from 2.285 to 2.316% available chlorine.

EXAMPLE V

Into a laboratory mixer was added about 18.79 parts of soft water, 29.21 parts of a sodium hypochlorite solution (8.4 wt-% active), 29.34 parts of sodium metasilicate (Diamond Shamrock Corp.) and 22.65 parts of sodium tripolyphosphate. The resulting material was cast in small capsules and measured for available chlorine.

EXAMPLE VI

Example V was repeated except that 16 parts of soft water were substituted for the 18.79 parts of soft water, 25 parts of sodium hypochlorite was substituted for the 29.21 parts, 25 parts of sodium metasilicate were substituted for the 29.34 parts, and 22 parts of sodium tripolyphosphate was substituted for the 22.65 parts. Further, an additional 12.0 parts of chlorinated trisodium phosphate was added to the mixture.

TABLE 1

| Days After Preparation | Available Chlorine 0 | 95 | 119 | 158 | 182 |
|---|---|---|---|---|---|
| Ex. V | 1.39 | — | 0.27 | — | 0.15 |
| Ex. VI | 2.20 | 0.64 | — | 0.49 | — |

These results indicate that the compositions containing both chlorinated sodium tripolyphosphate and sodium hypochlorite can, at least in the laboratory, exhibit substantially improved chlorine retention. Example V free of the chlorinated trisodium phosphate lost a higher proportion of active chlorine when compared to the preparation of Example VI which lost less of its available chlorine.

The above discussion, description, and Examples provides a sufficient basis to understand the invention. While a variety of embodiments can be made without departing from the spirit and scope of the invention, the invention resides in the claims hereinafter appended.

I claim:

1. A solid cast warewashing detergent composition having improved cleaning properties, improved bleaching properties, and which can readily dissolve by the action of a water spray to form an active cleaning solution, which consists essentially of a solid mass formed by the hydration and addition of:

(a) about 20 to 30 wt-% of an alkali metal metasilicate (an $Na_2O:SiO_2$ ratio of about 1:1);

(b) about 20 to 25 wt-% of an alkali metal phosphate;

(c) about 20 to 30 wt-% of an alkali metal hypochlorite;

(d) about 10 to 15 wt-% of a chlorinated alkali metal phosphate compound formed by the reaction between an alkali metal hypochlorite and an alkali metal phosphate compound; and (e) an effective amout of water for hydration; wherein each percentage is based upon the cast composition.

2. The cast composition of claim 1 wherein the solid mass is formed in a container in which the solid mass is distributed to the point of use.

3. The cast composition of claim 2 wherein the container has a screw-on cap.

4. The cast composition of claim 1 wherein the weight of the cast solid is greater than 200 grams.

5. The cast composition of claim 1 wherein the weight of the solid mass is about 500 to 5,000 grams.

6. The cast composition of claim 1 wherein the chlorinated alkali metal phosphate and the alkali metal hypochlorite are encapsulated.

7. The cast composition of claim 6 wherein the alkali metal hypochlorite and the chlorinated alkali metal phosphate are separately encapsulated.

8. The cast composition of claim 1 wherein the solid mass is formed by consquent hydration and addition of:

(a) about 24 to 26 wt-% of a sodium metasilicate ($Na_2O:SiO_2$ ratio of about 1:1);

(b) about 20 to 24 wt-% of sodium phosphate;

(c) about 24 to 26 wt-% of sodium hypochlorite;

(d) about 10 to 15 wt-% of a chlorinated sodium phosphate; and (e) about 15 to 17 wt-% of water for hydration;

wherein each percentage is based on the total weight of the solid mass.

9. A solid cast warewashing detergent composition having improved cleaning properties and having improved bleaching properties which is readily dissolvable by the action of a water spray to form an active cleaning solution, which consists of a solid mass formed by the hydration of:

(a) about 25 wt-% of a sodium metasilicate having an $Na_2O:SiO_2$ ratio of about 1:1;

(b) about 22 wt-% of an alkali metal phosphate;

(c) about 25 wt-% of an alkali metal hypochlorite;

(d) about 12 wt-% of a chlorinated sodium phosphate; and (e) about 16 wt-% of water for hydration;

wherein each percentage is based on the total weight of the solid mass.

10. A solid cast warewashing detergent composition having improved cleaning, improved bleaching, and ready dissolution as a result of the action of a water spray to form an active cleaning solution, which consists essentially of the product of:

(a) forming a castable mass by combining:

(i) about 20 to 30 wt-% of an alkali metal metasilicate having an $Na_2O:SiO_2$ ratio of about 1:1;

(ii) about 20 to 25 wt-% of an alkali metal phosphate;

(iii) about 20 to 30 wt-% of an alkali metal hypochlorite;

(iv) about 10 to 15 wt-% of a chlorinated alkali metal phosphate compound formed by the reaction between an alkali metal hypochlorite and an alkali metal phosphate compound; and (v) about 12 to 18 wt-% of water for hydration; wherein each percentage is based upon the weight of the solid mass; and (b) placing the castable mass in a container and permitting the castable mass to solidify.

11. The castable composition of claim 10 wherein the container has a screw-on cap.

12. The cast composition of claim 10 wherein the weight of the castable mass is between about 500 and 5,000 grams.

13. The cast composition of claim 10 wherein the alkali metal hypochlorite and the chlorinated alkali metal phosphate are encapsulated.

14. The cast composition of claim 13 wherein the alkali metal hypochlorite and the chlorinated alkali metal phosphate are separately encapsulated.

15. The cast composition of claim 11 wherein the container has a film over the composition underneath the cap.

16. The cast composition of claim 10 wherein the castable mass consists essentially of:

(a) about 24 to 26 wt-% of a sodium metasilicate having an $Na_2O:SiO_2$ ratio of about 1:1;

(b) about 20 to 24 wt-% of a sodium phosphate;

(c) about 24 to 26 wt-% of a sodium hypochlorite;

(d) about 10 to 15 wt-% of a chlorinated sodium phosphate; and (e) about 15 to 17 wt-% of water for hydration, wherein each percentage is based upon the weight of the castable mass.

17. A method to cast a solid warewashing detergent composition having improved cleaning, improved bleaching, and ready dissolution as a result of the action of a water stream to form an active cleaning composition, which comprises:

(a) forming a castable mass and casting the mass at a temperature of less than about 130° F. (about 55° C.) wherein the castable mass consists essentially of:

(i) about 20 to 30 wt-% of an alkali metal metasilicate having an $Na_2O:SiO_2$ ratio of 1:1;

(ii) about 20 to 25 wt-% of an alkali metal phosphate;

(iii) about 20 to 30 wt-% of an alkali metal hypochlorite;

(iv) about 10 to 15 wt-% of a chlorinated alkali metal phosphate compound formed by the reaction between an alkali metal hypochlorite and an alkali metal phosphate compound; and (v) about 12 to 18 wt-% of water for hydration; wherein each percentage is based upon the weight of the castable mass; and (b) placing the castable mass in a container and permitting the mass to solidify.

18. The method of claim 17 wherein the container has a screw-on cap.

19. The method of claim 17 wherein the weight of the castable mass is between about 500 to 5,000 grams.

20. The method of claim 17 wherein the alkali metal hypochlorite and the chlorinated alkali metal phosphate are encapsulated.

21. The method of claim 20 wherein the alkali metal hypochlorite and the chlorinated alkali metal phosphate are separately encapsulated.

22. The method of claim 18 wherein the container has a film over the composition underneath the cap.

23. The method of claim 22 wherein the castable mass consists essentially of:

(a) about 24 to 26 wt-% of a sodium metasilicate having an $Na_2O:SiO_2$ ratio of 1:1;

(b) about 20 to 24 wt-% of a sodium phosphate;

(c) about 24 to 26 wt-% of a sodium hypochlorite;

(d) about 10 to 15 wt-% of a chlorinated sodium phosphate; and (e) about 15 to 17 wt-% of water for hydration.

24. A cast warewashing detergent composition comprising the product of the method of claim 17.

25. A method of cleaning ware which comprises directing a water spray upon the cast composition of claim 1 to produce a cleaning solution and contacting soiled ware with the cleaning solution to produce cleaned ware.

26. A method of cleaning ware which comprises directing a water spray upon the cast composition of claim 9 to produce a cleaning solution and contacting soiled ware with the cleaning solution to produce cleaned ware.

27. A method of cleaning ware which comprises directing a water spray upon the cast composition of claim 10 to produce a cleaning solution and contacting soiled ware with the cleaning solution to produce cleaned ware.

28. A method of cleaning ware which comprises directing a water spray upon the cast composition of claim 24 to produce a cleaning solution and contacting soild ware with the cleaning solution to produce cleaned ware.

* * * * *